US008628703B2

(12) United States Patent
Lauro

(10) Patent No.: US 8,628,703 B2
(45) Date of Patent: Jan. 14, 2014

(54) APPARATUS AND SYSTEM FOR FORMING CONCRETE BLOCKOUTS

(76) Inventor: John Melecio Lauro, Kaneohe, HI (US)

( * ) Notice: Subject to any disclaimer, the term of this patent is extended or adjusted under 35 U.S.C. 154(b) by 189 days.

(21) Appl. No.: 13/399,965

(22) Filed: Feb. 17, 2012

(65) Prior Publication Data

US 2013/0216759 A1 Aug. 22, 2013

(51) Int. Cl.
*E04B 1/16* (2006.01)

(52) U.S. Cl.
USPC ..... 264/35; 264/333; 249/13; 249/83; 52/577

(58) Field of Classification Search
None
See application file for complete search history.

(56) References Cited

U.S. PATENT DOCUMENTS

| | | | | |
|---|---|---|---|---|
| 1,391,988 A | | 9/1921 | Zents | |
| 1,603,245 A | | 10/1926 | Pederson | |
| 2,202,147 A | * | 5/1940 | Gerriets | 52/99 |
| 2,684,518 A | | 6/1974 | Whitlock | |
| 3,821,338 A | | 6/1974 | Faust | |
| 4,261,598 A | | 4/1981 | Cornwall | |
| 4,823,527 A | | 4/1989 | Harbeke | |
| 5,099,887 A | | 3/1992 | Hooper | |
| 5,347,786 A | * | 9/1994 | Hodges | 52/577 |
| 6,349,975 B1 | | 2/2002 | Heil | |
| 7,013,927 B2 | * | 3/2006 | Beaumont | 138/113 |
| 8,479,466 B2 | * | 7/2013 | Roulston | 52/295 |
| 2012/0096805 A1 | * | 4/2012 | Vasta | 52/749.13 |

FOREIGN PATENT DOCUMENTS

| | | |
|---|---|---|
| DE | 3508706 A1 | 12/1985 |
| FR | 2889990 A1 | 3/2007 |
| WO | 0204758 A1 | 1/2002 |

* cited by examiner

*Primary Examiner* — Mary F Theisen
(74) *Attorney, Agent, or Firm* — Seth M. Reiss, AAL, ALLLC

(57) ABSTRACT

A method and apparatus is provided for preventing a composite material used in forming slabs for residential and commercial construction from entering a predefined space that is maintained open for pipes, plumbing fixtures and other conduits. The preform apparatus comprises a body, apron and cover. The apparatus is assembled by placing the preform body in position to occupy a predefined space, press fitting the apron down over and around the body and the cover on top of the body. Thereafter, the composite material is poured around the preform and allowed to cure. After curing, the preform body and the cover are removed, leaving a material free void within and below the predefined space that the preform had occupied. The preform is straightforward, inexpensive to produce, easy to use and is assembled without fasteners and without disturbing the soil below the slab or the moisture/vapor barrier.

23 Claims, 7 Drawing Sheets

Top View

Front View

APPARATUS AND SYSTEM FOR FORMING CONCRETE BLOCKOUTS

BACKGROUND OF INVENTION

1. Technical Field

The present invention relates generally to preforms used in the construction industry. In particular, the present invention discloses preforms and methods for using the same to prevent concrete from entering the pipe installation areas when pouring concrete slabs.

2. Background Art

In the construction of residential and commercial complexes, pipes or conduits are used for several purposes such as plumbing, electrical and gas lines, heating, and disposing garbage. Pipes or conduits are installed in the ground prior to the pouring of concrete slabs. The area around, above and below these pipes and conduits typically constitute the space required to be maintained open for accommodating the pipes or conduits as well as for installing other devices such as floor sinks and garbage chute repositories.

Traditionally, these openings were kept free of concrete by manually building a brick structure around the predefined spaces. Concrete was then poured around the brick structures and after hardening of the concrete, the brick structures were destroyed. However, this process entailed additional labor time. Also, at times, the destroyed bricks were rendered no further use; thus adding to construction costs.

Therefore, preforms were developed and are widely used nowadays to maintain a concrete-free area around, above and below plumbing and other conduits. The preforms are designed with a perspective of lowering the labor time and cost associated with the formation of structures around the openings maintained for plumbing and electrical conduits and the like.

The conventional preform is fabricated from lumber, on site. The worker will take lumber, sometimes scrap lumber lying around the jobsite, and saw, hammer and nail the lumber into a box-like wooden preform structure of suitable size and shape. The completed wooden preform is set down in place around the pipe or other conduit protruding from the soil. The preform is then secured in place using wooden or metal stakes that penetrate the preform and also the soil directly below the preform. After the concrete is poured and allowed to cure, the sides of the preform are removed, rendering the lumber unusable thereafter and sacrificed.

However, this manner of constructing wooden preforms ad hoc on the jobsite adds unnecessarily to the cost of construction. Typically the time to construct a single blockout preform may be a half hour or more. This time takes the carpenter away from other tasks requiring carpentry skills. There is, in addition, the expense of the lumber used in the preforms and the risk of injury to the worker in fabricating the preform on-site.

Accordingly, it is a primary object of the instant invention to provide an apparatus and method for forming preforms for concrete blockouts that avoid the time, expense and risk of injury consequent to having to fabricate wooden preforms on site in advance of a concrete slab being poured.

Often, the soil under the construction slab is prepared using insecticides and/or pesticides. The pesticide treated soil is then covered with a moisture/vapor barrier material, such as treated plastic sheets. The barrier is laid down over the soil prior to the pouring of the slab. The soil treatment and barrier come with warranties. These warranties are relied upon by the contractor constructing the building, and also by the owner of the finished building, for protection against the later infiltration of pests and moisture. The use of the stakes to secure the wooden preforms to the soil, penetrates the soil and the moisture barrier materials and voids the warranties that accompany these materials and treatments.

It is a further primary object of the present invention to provide an apparatus and method for creating concrete blockouts in order to preserve openings around, above and below plumbing and other conduits during the process of pouring concrete construction slabs, that do not compromise the moisture/vapor barrier below the slab and the warranties that accompany the treated soil and moisture barrier material.

It is not uncommon when using wooden site-constructed preforms that poured concrete will overtop the preform and/or seep through cracks in the preform, resulting in concrete seeping into the opening that the preform was intended to maintain material free. When this occurs, it becomes necessary to chip away at the unwanted hardened concrete from the pipe and out from the void that was to have been maintained below slab grade. Removing the unwanted concrete can be time consuming and not-uncommonly results in damage to the adjoining slab.

It is a further primary object of the present invention to provide an apparatus and method for forming concrete blockouts that effectively prevent composite materials from seeping into the void to be maintained around pipes and other conduits or from filling the space below slab intended to be maintained open for plumbing fixtures such as floor sinks.

The patent prior art discloses a variety of preform apparatus that serve to preserve openings around and below plumbing fixtures and conduits during the pouring of concrete slabs. The pre-fabricated preforms come in a variety of forms, are made from different materials, and function differently.

U.S. Pat. No. 1,391,988 to Zents, for example, discloses a mold for forming spaces in concrete floors to receive pipes for heating and plumbing. The mold comprises two sections fitted together and is meant to be easily removable and reusable. The mold has a cover which can be rotated to loosen the mold from the concrete. The mold is attached to the floor framework using a bolt that extends through the floor slab into the ground.

U.S. Pat. No. 2,684,518 to Whitlock discloses a device for forming openings in concrete slabs for utility conduits and outlets. The device comprises a male sleeve telescoped inside a female sleeve, with the male sleeve having a securing flange that is nailed into the concrete form. The male sleeve with flange is removed after the slab is poured. A concrete plug is formed at the opposite end of the device that can be punched out later to make way for the pipe or conduit. The female sleeve remains inside the slab after the pour.

Also, U.S. Pat. No. 3,821,338 to Faust teaches a sleeve protector to prevent wet cement from entering the sleeve, with a large flanged bottom plate that is nailed to a plywood deck. The sleeve protector includes radially spaced apart set screws to space the sleeve protector from the centrally located pipe or conduit. A cover plate is placed on top of the sleeve protector to prevent entry of concrete into the sleeve.

These prior art preforms make the use of fasteners necessary for attaching the preform to the floor or to their component parts or both. When such devices are used on slab-on-grade foundations, the fasteners penetrate into the soil thus piercing the vapor barrier and disturbing the treated soil. Furthermore, assembly/disassembly of different parts of these devices is complicated; thus increasing the assembly/disassembly time. Also, the complexity and materials used in the prior art preforms render them expensive to produce, provided little advantage over the conventional wooden preforms described above that are fabricated on site.

There is a need for an easy-to-use, ready to assemble preform that is inexpensive to produce, quick to assemble and disassemble requiring little effort, is simple with a minimum of parts, does not require fasteners, and does not require penetration of the treated soil or compromise of the moisture/vapor barrier.

SUMMARY OF THE INVENTION

The present invention relates to a preform for preventing a composite material used in construction from entering a predefined space. Specifically, the present invention relates to a preform for restricting concrete from flowing into an opening to be maintained around, above and below pipes, other conduits and plumbing fixtures.

In an aspect of the present invention, the preform includes a preform body with outside wall that approximates the predefined space. Associated with the preform body is an apron comprising a generally flat frame with an inside edge shaped and sized to fit over and abut the bottom of the outside wall of said preform body and that extends outwards therefrom. The apron extends outwards an area sufficient to maintain a void below said preform large enough to accommodate plumbing fixtures. The preform further comprises a cover shaped and sized to cover the top of said preform body.

Said preform is assembled without fasteners by placing said apron down over said preform body until that the inside edge of said frame of said apron abuts and lies against the bottom of the outside wall of said preform body. Additionally, said cover is placed over the top of the preform body.

Further according to a preferred embodiment, the preform includes lips disposed along the inside edge of said apron to abut the bottom of the outside wall of said preform body. Said lips are oriented upwards when said preform is assembled. Additionally, there may be lips disposed along the outside edge of said cover to abut and lie along the top of the outside wall of said preform body. These lips are oriented downwards when said preform is assembled.

Also according to a preferred embodiment, said preform body is further comprised of an outer collar spaced apart from an inner collar. Specifically, the inner collar is generally cylindrical in shape and the outer collar is generally rectangular in shape. More specifically, the inside collar is sized and shaped to encircle a plumbing, electrical or other conduits, or garbage chutes for example. Each collar has an inside and outside wall, said outside wall of said outer collar forming the outside wall of said preform body. According to a preferred embodiment, the inner collar is spaced apart from said outer collar of said preform body by means of arms that extend from the outside wall of said inner collar to the inside wall of said outer collar.

In one preferred embodiment, said outside wall of said preform body is inclined slightly outwards going from top to bottom. The lips disposed along the inside edge of said apron abut the bottom of the outside wall of said preform body. Similarly, lips disposed along the outside edge of said cover abut the top of the outside wall of said preform body. Both, the lips of said apron and the lips of said cover are inclined at the same angle as the outside wall of said preform body so as to lie in parallel against said wall of said preform body when the preform is assembled.

Specifically, the angle demonstrated by the outside wall and lips is between 91 and 95 degrees relative to said apron when the apron is placed over the preform body. More specifically, the angle demonstrated by the outside wall is 92 degrees relative to said apron. The inclination of the body wall and lips functions to prevent the parts of the preform from floating up and detaching, one from the other, when the composite material is poured around the preform.

The preform body, apron and cover are press fitted with each other.

According to another embodiment of the present invention, the cover and apron are secured to said preform body after assembly using an adhesive after press-fitting. The preferred adhesive is tape, as for example painters tape, duct tape or masking tape. The adhesive may also be glue, as for example PVC glue.

In another aspect of the present invention, a method is disclosed for preventing a composite material used in construction from entering a predefined space. The method utilizes the preform described above comprised of a preform body, an apron and a cover. The preform body has an outside wall and approximates the predefined space. The outside wall of said preform body is inclined outwards going from top to bottom. Further, the apron has a generally flat frame having an inside edges shaped and sized to fit over and abut the outside wall of said preform body and extend outwards therefrom. Furthermore, the cover is shaped and sized to cover the top of the preform body.

The method of the present invention comprises first, the step of assembling the three components of the above-described preform within the predefined space. During the assembly, the preform body is placed in position within the predefined space. The preform body has an inner collar with an inside wall spaced apart from the outer collar and the preform body is placed in position within the predefined space by placing the inner collar of said preform body over and around a conduit extending upwards from within the predefined space. According to one embodiment of the method of the present invention, the inside wall of said inner collar is adhered to the conduit using adhesive. In an embodiment, the inner collar and conduit is made of PVC material and the adhesive is PVC glue. In a further step of the method, the apron of the preform is placed down over said preform body until that the inside edge of the apron frame lies against the bottom of the outside wall of said preform body. Thereafter, said preform cover is placed over the top of the preform body.

The apron and cover are optionally secured to the outside wall of the preform body using an adhesive. Further, according to the embodiment of the preform having lips, the lips disposed along the inside edge of said apron abut the bottom outside wall of said preform body. The lips are oriented upwards during assembly. Similarly, lips disposed along the outside edge of said cover abut the top outside wall of said preform body and are oriented downwards during assembly.

After assembly, the composite material is introduced around the assembled preform. The composite material, in a liquid state when poured, is allowed to cure. Post curing, the cover and the preform body are removed from the preform, leaving a composite material free void within and below the predefined space that the preform had occupied.

BRIEF DESCRIPTION OF DRAWINGS

The various embodiments of the invention will hereinafter be described in conjunction with the appended drawings provided to illustrate and not to limit the invention, in which the elements are not necessarily shown to scale, wherein like designations denote like elements, and in which.

DETAILED DESCRIPTION OF PREFERRED EMBODIMENTS

Figure 1:
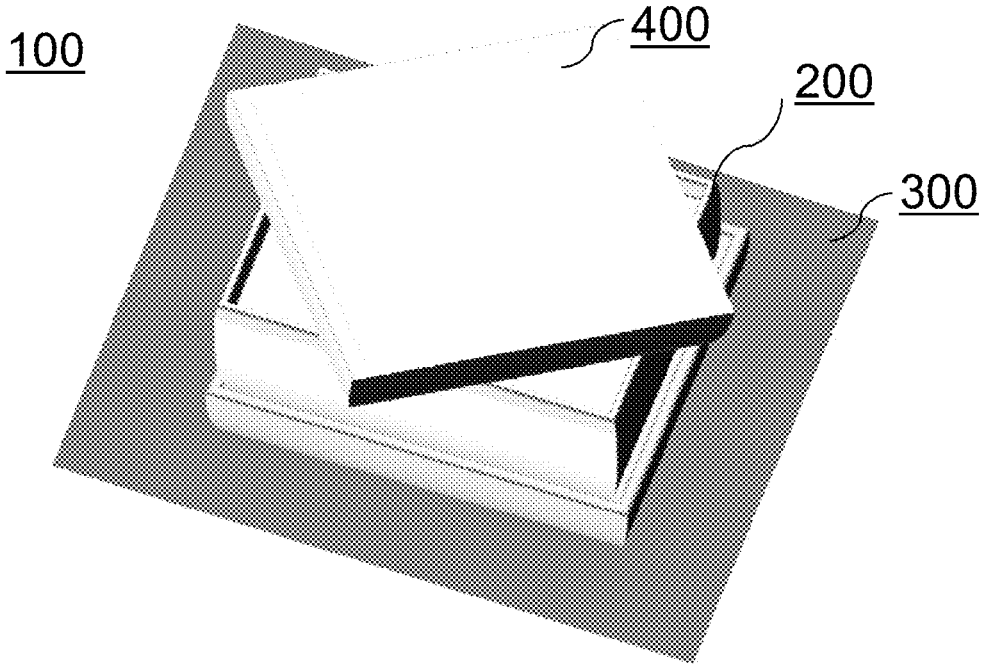
FIG. 1 illustrates the three component parts of a preform apparatus for forming concrete blockouts, in accordance with an embodiment of the invention.

FIG. 1 illustrates a preform 100 for use in the construction industry in accordance with an embodiment of the present invention. The preform 100 prevents the entry of a composite material in a predefined space. Specially, the preform 100 restricts concrete from flowing into an opening provided for pipes, other conduits and plumbing fixtures. In an embodiment, along with the opening, the preform 100 prevents the concrete from entering a void present below the opening. Both, the opening and the void constitute space for accommodating components such as floor sinks, garbage chutes repositories and other plumbing fixtures.

The preform 100 includes a preform body 200, an apron 300 and a cover 400. The preform body 200 approximates the predefined space and functions as a basis for assembling the apron 300 and the cover 400. Once the preform body 200 is aligned with the predefined space, the apron 300 is placed over the preform body 200. The apron 300 offers rigidity to the preform 100 and also assists in maintaining the void below the preform 100 by preventing the introduction of composite material from the sides of body 200. Further, the cover 400 is rested over the preform body 200 thus preventing entry of dust, concrete and other particles from the top of the preform 100.

The assembly of the preform body 200, apron 300 and cover 400 constituting the preform 100 does not make use of fasteners. Also, the preform 100 is secured in position within the predefined space without using any fasteners.

Figure 2:
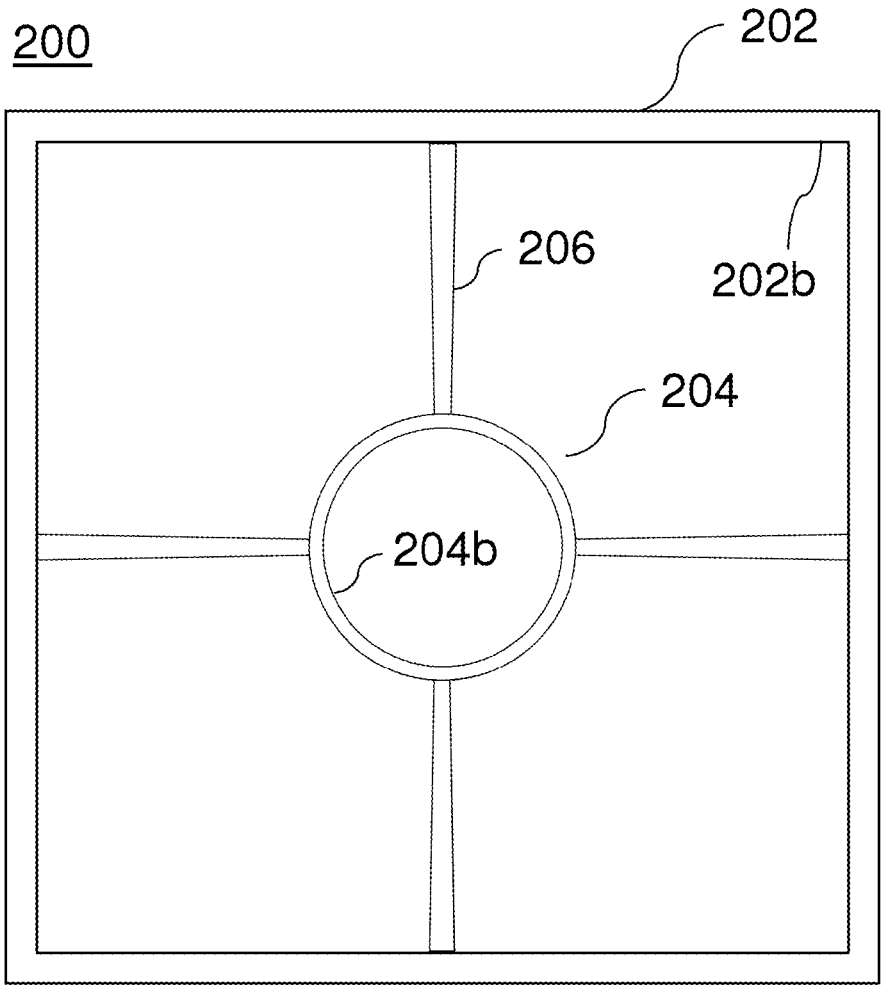
FIG. 2 illustrates various views of a preform body, in accordance with an embodiment of the invention.
Figure 2:
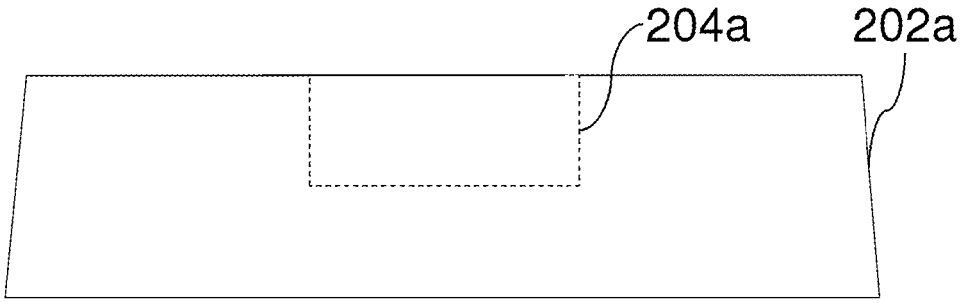

FIG. 2 illustrates the preform body 200 in accordance with an embodiment of the present invention. The preform body 200 is closed along its sides and is left open on the top and bottom. Further, the preform body 200 approximates the predefined space in which the entry of concrete is to be prevented. Specifically, the preform body 200 surrounds the opening accommodating the pipes or other conduits and above the placement of below-grade plumbing fixtures.

The preform body 200 includes an outer collar 202. The outer collar 202 is, according to the preferred embodiment illustrated, rectangular in shape with an outside wall 202*a* and an inside wall 202*b*. The outside wall 202*a* also forms an outside wall of the preform body 200. Further, the outside wall 202*a* in the embodiment depicted is inclined at an angle for snap fitting the apron 300 and the cover 400. The angle of the outside wall 202*a* ranges from 91 degrees to 95 degrees with respect to the apron 300 when the apron 300 is placed over the preform body 200. Specifically, the angle of the outside wall 202*a* is 92 degrees relative to the apron 300.

Furthermore, the inside wall 202*b* is associated with arms 206. The arms 206 extend from the inside wall 202*b* to the outside wall of an inner collar 204 and serve to support the inner collar 204.

The inner collar 204 is spaced apart from the outer collar 202 and accommodates pipes or conduits. The inner collar 204 is, according to the preferred embodiment illustrated, cylindrically shaped and includes an outside wall 204*a* and an inside wall 204*b*. The outside wall 204*a* is in contact with arms 206 extended from the inside wall 202*b* of the outer collar 202. In addition, the inside wall 204*b* receives the pipes or other conduit of fixture.

In an embodiment of the present invention, the preform body 200 is a single piece of plastic which may formed by injection molding. In another embodiment, the arms 206 are generally glued to the inside wall 202*b* of the outer collar 202 and the outside wall 204*a* of the inner collar 204.

Figure 3:
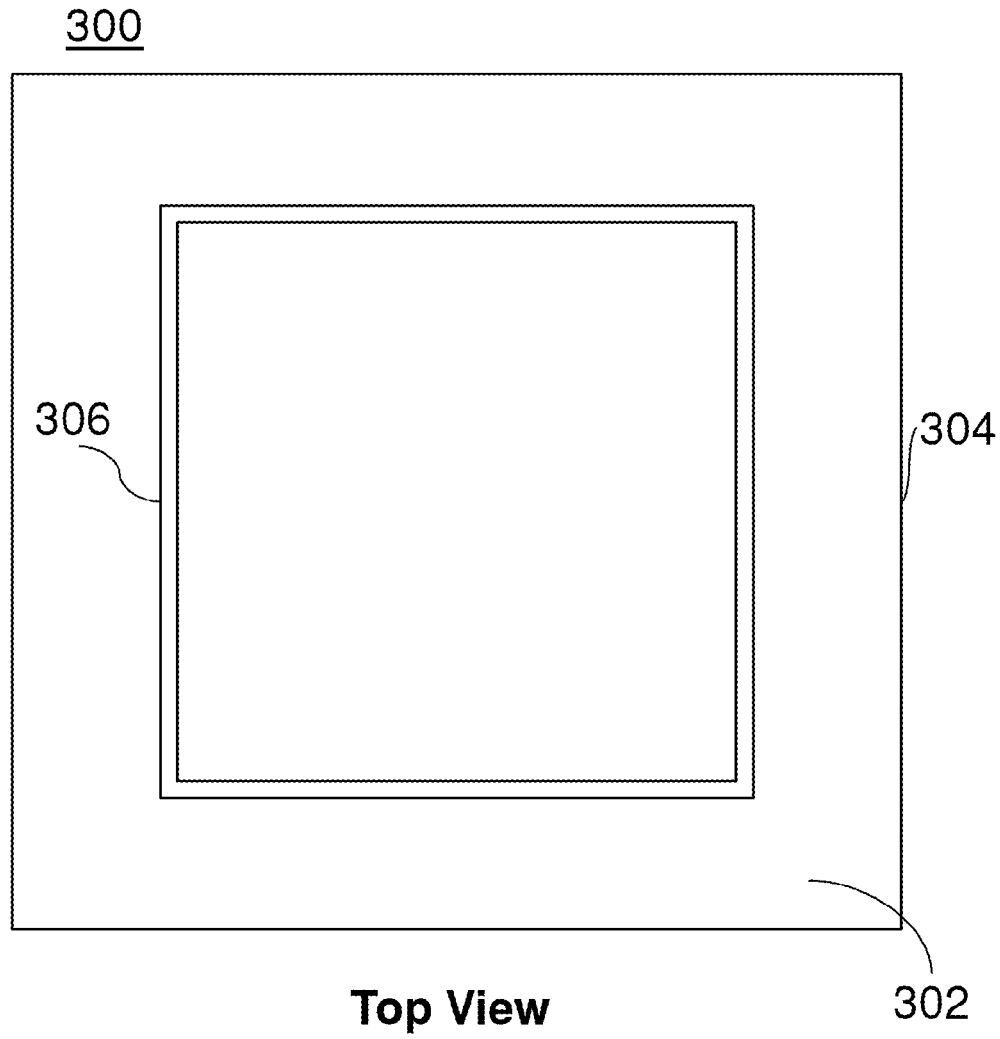
FIG. 3 illustrates various views of a preform apron, in accordance with an embodiment of the invention.
Figure 3:
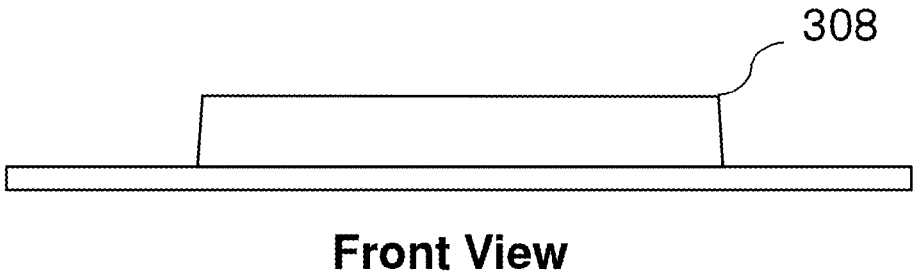

FIG. 3 illustrates the apron 300, in accordance with an embodiment of the present invention. The apron 300 is placed over the preform body 200 and encloses the below-grade void present below the predefined space. Also, the apron 300 provides rigidity to the preform 100.

According to the embodiment depicted, the apron 300 is rectangular in shape and includes a flat frame 302. The flat frame 302 has an outside edge 304 and an inside edge 306. The outside edge 304 extends outwards over an area from the inside edge 306. Specifically, the outside edge 304 rests over an area that is beyond the below-grade void lying below the predefined space. Thereby, the concrete is prevented from entering this void; thus enabling the plumbing fixtures and other accessories to be accommodated therein.

The inside edge 306 is shaped and sized to fit over the preform body 200. Preferably, the shape and size of the inside edge 306 approximates the size of a bottom portion of the outside wall 202*a* of the preform body 200. More preferably, the inside edge 306 abuts the bottom of the outside wall 202*a* of the preform body 200 when the apron 300 is placed over the preform body 200.

Further, according to the depicted embodiment, the inside edge 306 contains lips 308 along its periphery. The lips 308 disposed along the inside edge 306 are inclined at an angle. The angle is same as the angle of the outside wall 202*a* of the preform body 200. This arrangement of the angle of the lips 308, and the shape and size of the inside edge 306, facilitates the apron 300 to be snap fitted over the outside wall 202*a* of the preform body 200.

Figure 4:
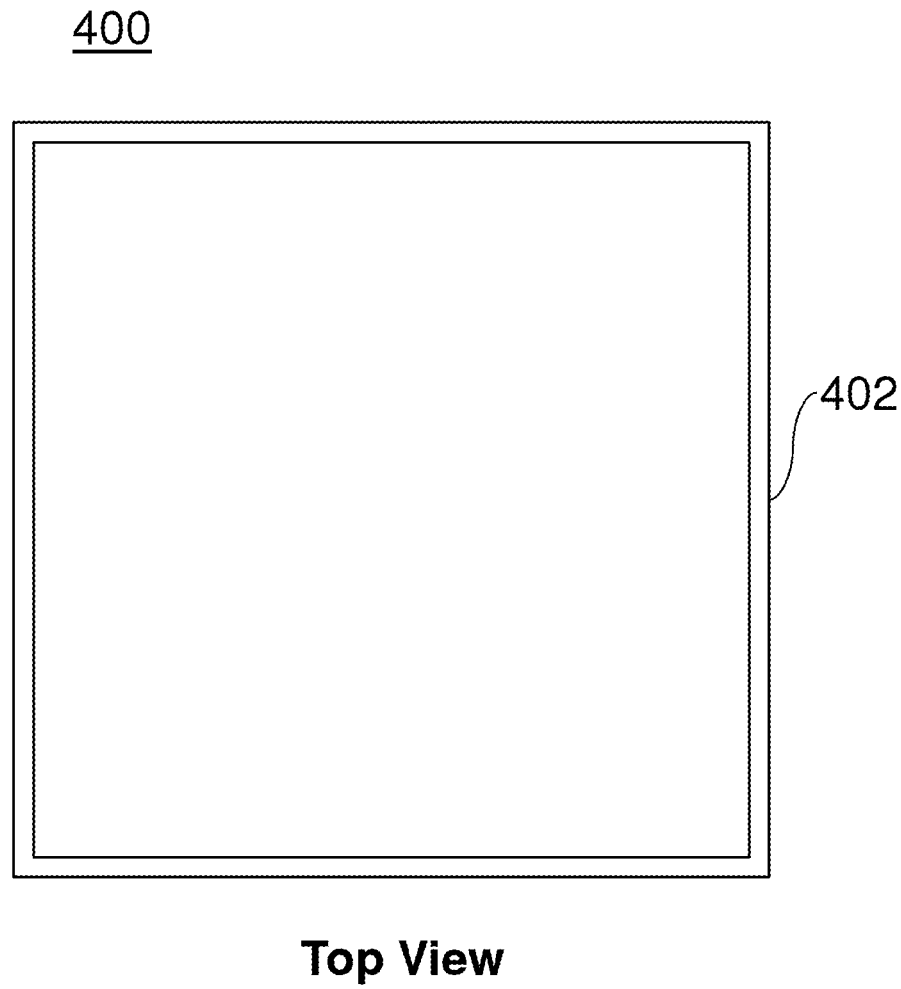
FIG. 4 illustrates various views of a preform cover, in accordance with an embodiment of the invention.

FIG. 4 illustrates the cover 400 in accordance with an embodiment of the present invention. The cover 400 encloses the preform body 200. Specifically, the cover 400 is shaped and sized to cover the top void of the preform body 200. More specifically, the cover 400 includes an outside edge 402 shaped and sized to fit over the top surface of the outside wall 202*a* of the preform body 200.

According to the embodiment illustrated, along the periphery of the outside edge 402 of the cover 400 are disposed lips 404. The lips 404 are inclined at an angle and abut the top surface of the outside wall 202*a* of the preform body 200. The angle of the lips is same as the angle of the outside wall 202*a* of the preform body 200.

Moreover, the cover 400 prevents dust, concrete and other particles from entering from the top of the preform 100.

Figure 5:
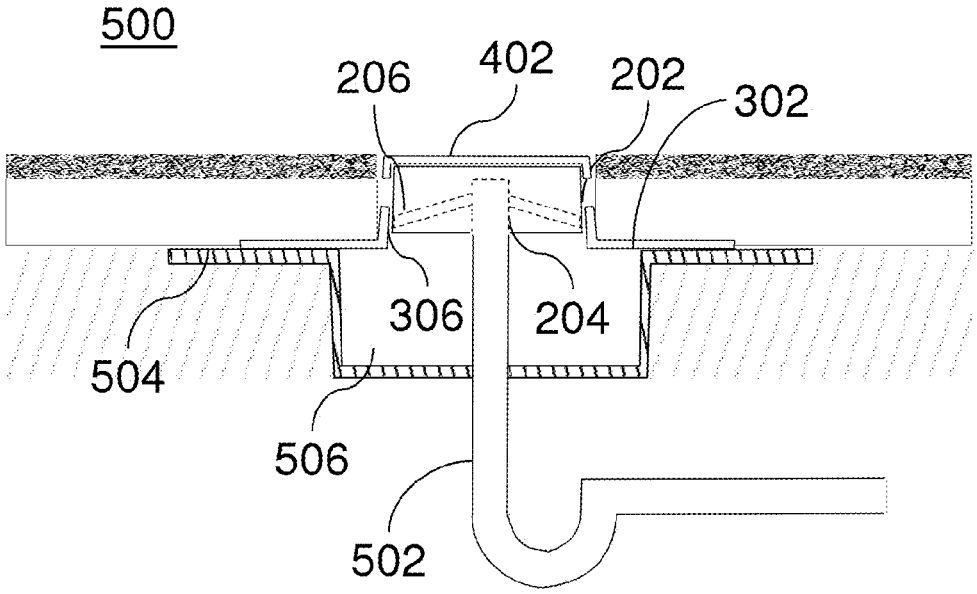
FIG. 5 illustrates various views of an assembly model of the apparatus for forming concrete blockouts, in accordance with an embodiment of the invention, showing plumbing conduit and below grade plumber's pit.

FIG. 5 illustrates a construction site 500 including the preform 100 in accordance with an embodiment of the present invention. In this embodiment, the construction site 500 illustrated is a slab-on-grade foundation.

The construction site 500 includes a pipe 502 laid and positioned at a predetermined location before pouring the concrete. The predetermined location is selected based on the design of the building to occupy the construction site 500. Further, the pipe 502 represents a conduit laid for any variety of reasons including, but not limited to, plumbing, electrical lines, heating and garbage collection.

Furthermore, the preform 100 is in contact with the pipe 502. Specifically, the inside wall 204*b* of the inside collar 204 of the preform body 200 is attached around the pipe 502. The attachment may be further facilitated by applying tape or glue on at least a portion of the inside wall 204*b* and the outside of the top portion of the pipe 502. Similarly, the outside wall 202*a* of the outer collar 202 is abutted to the inside edge 306 of the apron 300. The abutment may include but is not limited to snap fitting of the outside wall 202*a* and the inside edge 306. Additionally, the abutment can be enhanced by application of tape or glue on at least a portion of the outside wall 202*a* of preform body 200 and the inside edge 306 of preform apron 300. Further, the flat frame 302 extending outwards from the inside edge 306 rests over a plurality of grade level surfaces 504. A below grade void 506 is thereby maintained below the flat frame 302 of apron 300. The void 506 is maintained for the installation of plumbing fixtures, as for example floor sinks. In an embodiment, the plurality of grade level surfaces 504 comprise treated soil or soil covered by a moisture/vapor barrier.

Moreover, the cover 400 encloses the preform body 200. Preferably, the outside edge 402 is shaped and sized to fit over the top surface of the outside wall 202*a* of the preform body 200. More preferably, the outside edge 402 is snap fitted to the top surface of the outside wall 202*a*. In order to enhance the fitting, an adhesive may be applied to at least a portion of the top aspect of the outside wall 202*a* of preform body 200 and the inside of the outside edge 402 of preform cover 400. Examples of suitable adhesive include but are not limited to tape and glue.

Further, the preform 100 does not make use of any fasteners for attachment of its component parts one to the other or for attachment of its component parts to the plurality of grade level surfaces 504. Thus, the treated soil is undisturbed and the moisture/vapor barrier is maintained.

Figure 6:
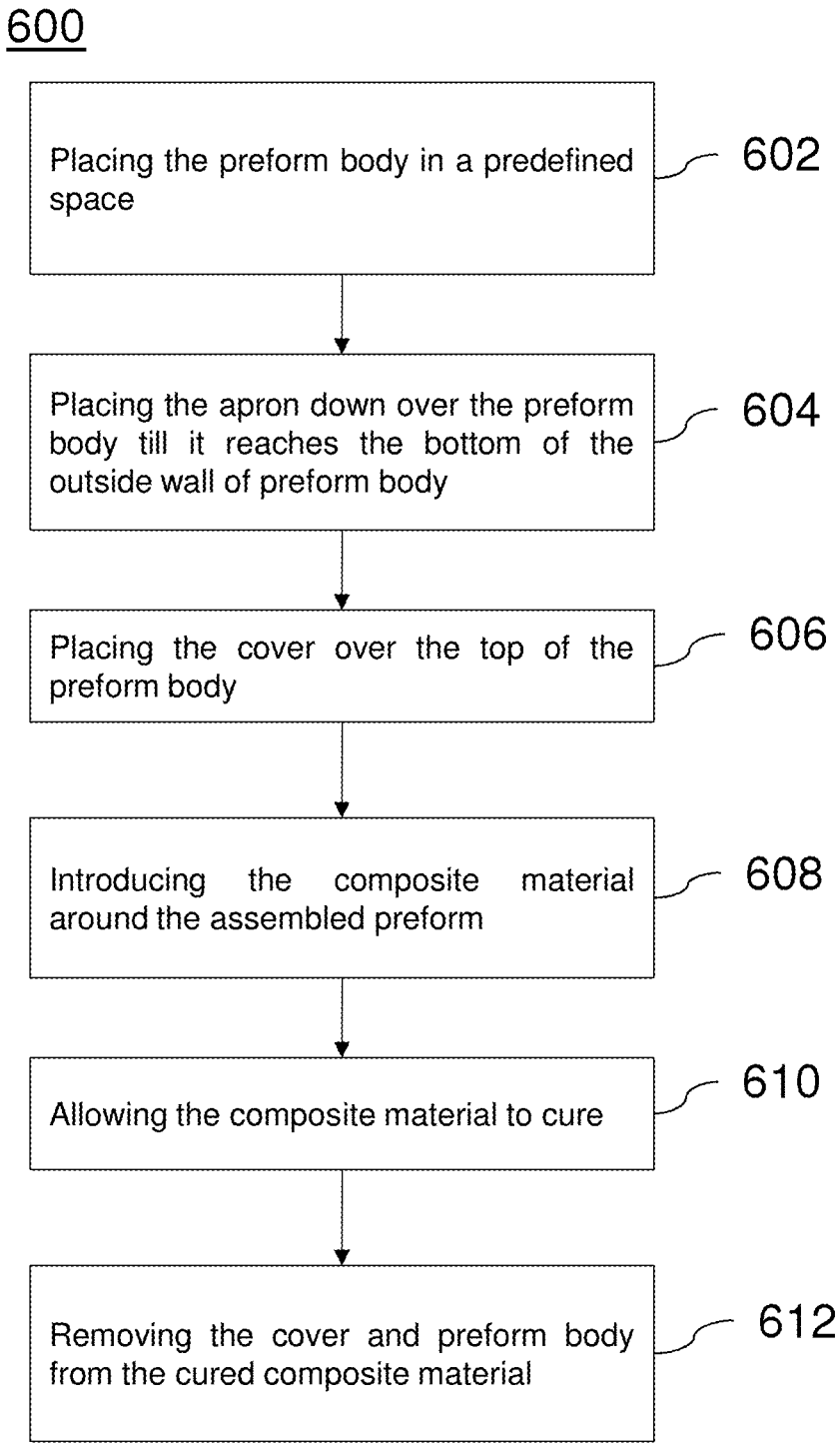
FIG. 6 is a flowchart of a method for preventing a composite material used in construction from entering a predefined space, in accordance with an embodiment of the invention.

Depicted in FIG. 6 is a flowchart 600 of a method for preventing a composite material used in construction from entering a predefined space, in accordance with an embodiment of the invention. The preform 100 described in the above embodiments and composed of different parts prevents the composite material from entering the predefined space.

At step 602, the preform body 200 is positioned to occupy the predefined space. The preform body 200 has an area corresponding to an area of the predefined space that needs to be maintained free of concrete material. Further, at step 604, the apron 300 is placed over and down around the preform body 200 until it reaches the bottom of the outside wall 202*a* of the preform body 200. Specifically, the inside edge 306 of the apron 300 abuts the bottom of the outside wall 202*a*. For enabling the abutting, the inside edge 306 is shaped and sized according to the bottom of the outside wall 202*a*. Still further, the cover 400 encloses the preform body 200 at step 606. The cover 400 is shaped and sized relative to the top of the preform body 200 for enclosing the preform body 200 without extending beyond the outside dimensions of the preform body 200.

After assembling the preform 100 as explained above, at step 608, the composite material is introduced around the preform 100. Preform 100 prevents the composite material from entering the predefined space or any void that is directly below the predefined space. The composite material is in a liquid state and is allowed to cure at step 610. Once the composite material is cured, at step 612, the cover 400 and preform body 200 are removed from the cured composite material, leaving a void within and below the predefined space that the preform 100 had occupied.

Figure 7:
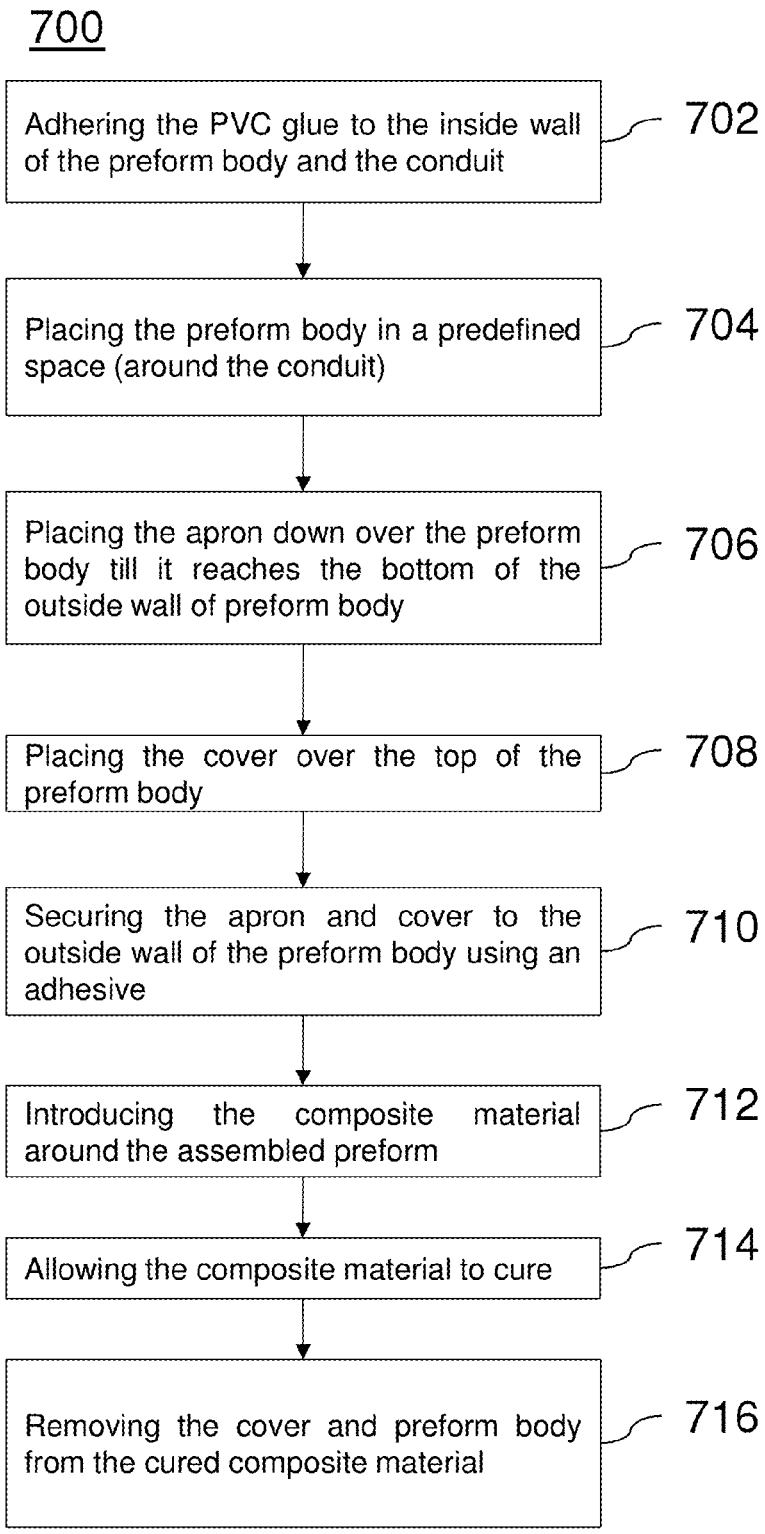
FIG. 7 is a flowchart of a method for preventing a composite material used in construction from entering a predefined space, in accordance with another embodiment of the subject invention.

Illustrated in FIG. 7 is a flowchart 700 of a method for preventing a composite material used in construction from entering a predefined space, in accordance with another embodiment of the invention. Specifically, the method prevents the concrete from entering in the opening provided for installing pipes or conduits. In an embodiment, along with the opening, the method prevents the concrete from entering a below-grade void present below the opening. The concrete is prevented from entering the opening and the void by the preform 100 in the following manner.

At step 702, an adhesive applied to the top outside surface of the pipe or conduit that occupies the predefined space and to the inside wall 204*b* of the inner collar 204. In an embodiment, the pipe or conduit and the inner collar 204 is made of PVC material and the adhesive is PVC glue. After aligning the inner collar 204 with the pipe or conduit, at step 704, the preform body 200 is placed in the predefined space and adhered to the pipe or conduct. The preform body 200 is closed at all sides and includes an area corresponding to an area of the predefined space. Also, the outside wall 202*a* of the preform body 200 is inclined outwards going from top to bottom. Further, at step 704, the pipe or conduit and the inner collar 204 is adhered due to the application of adhesives. The adherence of the pipe or conduit and the inner collar 204 enables the preform body 200 to be retained in place around the pipe or conduit notwithstanding upwards boyant forces exerted on the preform body as a result of poured liquid concrete.

Further, the apron 300 having a flat frame 302 is placed over the preform body 200, at step 706. The inside edge 306 of the flat frame 302 abuts the bottom of the outside wall 202*a* of the preform body 200. For enabling the abutting, the inside edge 306 is shape and sized according to the bottom of the outside wall 202*a*. Further, the inside edge 306 is associated with lips 308. The lips 308 of the inside edge 306 face in an upward direction when the apron 300 is placed over the preform body 200.

At step 708, the cover 400 encloses the preform body 200. Specifically, the cover 400 is placed over the top of the preform body 200. The placement is such that the lips 404 abutting the top of the outside wall 202*a* are oriented in a downward direction.

After assembling the preform 100, at step 710, the apron 300 and the cover 400 are secured to the outside wall 202*a* of the preform body 200 using an adhesive. Example of adhesives that may be used include but are not limited to tape and glue.

At step 712, the composite material is introduced around the preform 100. The composite material is in a liquid state and is allowed to cure at step 714. Once the composite material is cured, at step 716, the cover 400 and preform body 200 are removed from the cured composite material, leaving a void within and below the predefined space that the preform 100 had occupied.

SUMMARY AND SCOPE

The various embodiments of the invention describe an apparatus and method employing such apparatus for preventing a composite material used in construction from entering a predefined space using a preform comprising a preform body that approximates the predefined space having an outside wall, an apron comprising a generally flat frame the inside edge of which is shaped and sized to fit over and abut the outside wall of said preform body and that extends outwards therefrom, and a cover shaped and sized to cover the top of the preform body.

The preform of the instant invention is inexpensive to fabricate and produce, easy and straightforward to use, does not employ fasteners, and does not penetrate or compromise pesticide treated soil or any moisture/vapor barrier underlying the construction slab. The apparatus and method described and illustrated facilitates the construction of slab foundations and slab floors for residential and commercial buildings at lower cost and with less time and effort, freeing site workers to preform other tasks requiring carpentry skills, and avoid unnecessary worker injuries. The instant invention provides a straightforward and easy solution for forming concrete block-outs that is simple, inexpensive and easy to implement and that offers an alternative to the conventional and commercially available preforms.

While the preferred embodiments of the invention have been illustrated and described, it will be clear that the invention is not so limited. Numerous modifications, changes, variations, substitutions and equivalents will occur to those skilled in the art, without deviating from the spirit and scope of the invention. By way of example and not by way of limitation, the preforms and its component parts can be constructed in a number of shapes and sizes, from a variety of materials. The inside and outside collars of preform body 200 can be spaced apart in a number of different manners. Lips 308 and 404 can be tapered or pressure fitted to preform body 200, and the outside wall of body 200 can be grooved to receive an inward projection from lips 308 and 404. Similarly, other manners of attaching apron 300 and cover 400 to preform body 200 and for securing the inside collar 204 to the outside of pipe or conduit 502 can be employed. All such modifications should be deemed within the intent and scope of the instant invention, as defined in the following claims.

What is claimed is:

1. A preform for preventing a composite material used in construction from entering a predefined space, the preform comprising:

a preform body that approximates the predefined space having an outside wall;

an apron comprising a generally flat frame the inside edge of which is shaped and sized to fit over and abut the bottom of the outside wall of said preform body and that extends outwards therefrom; and a cover shaped and sized to cover the top of said preform body;

wherein said preform is assembled without fasteners by placing said apron down over said preform body until that the inside edge of said frame of said apron lies against the bottom of the outside wall of said preform body, and placing said cover over the top of the preform body.

2. The preform according to claim 1, further comprising lips disposed along the inside edge of said apron to abut the bottom of the outside wall of said preform body, said lips oriented upwards when said preform is assembled.

3. The preform according to claim 1, further comprising lips disposed along the outside edge of said cover to abut the top of the outside wall of said preform body, said lips oriented downwards when said preform is assembled.

4. The preform according to claim 1, wherein said preform body is further comprised of an outer collar spaced apart from an inner collar, each collar having an inside and outside wall, said outside wall of said outer collar forming the outside wall of said preform body.

5. The preform according to claim 4, wherein said inner collar is spaced apart from said outer collar of said preform body by means of arms that extend from the outside wall of said inner collar to the inside wall of said outer collar.

6. The preform according to claim 1, wherein the said outside wall of said preform body is inclined outwards going from top to bottom.

7. The preform according to claim 6, further comprising lips disposed along the inside edge of said apron to abut the bottom of the outside wall of said preform body and lips disposed along the outside edge of said cover to abut the top of the outside wall of said preform body, wherein the lips of said apron and said cover are inclined at the same angle as the outside wall of said preform body so as to lie against said outside wall when the preform is assembled.

8. The preform according to claim 6, wherein the angle demonstrated by the outside wall is 92 degrees relative to said apron when the apron is placed over the preform body.

9. The preform according to claim 6, wherein the angle demonstrated by the outside wall is between 91 and 95 degrees relative to said apron when the apron is placed over the preform body.

10. The preform according to claim 4, wherein the inner collar is generally cylindrical in shape.

11. The preform according to claim 4, wherein the outer collar is generally rectangular in shape.

12. The preform according to claim 4, wherein the inner collar is sized and shaped to encircle a group consisting of plumbing and electrical conduits.

13. The preform according to claim 1, wherein said apron extends outwards an area sufficient to maintain a void below said preform large enough to accommodate plumbing fixtures.

14. The preform according to claim 1, wherein the cover and apron are secured to said preform body after assembly using an adhesive.

15. The preform according to claim 14, wherein the adhesive is selected from a group comprising tape and glue.

16. The preform according to claim 1, wherein the preform body, apron and cover are press fitted with each other.

17. A method for preventing a composite material used in construction from entering a predefined space using a preform comprising a preform body that approximates the predefined space having an outside wall, an apron comprising a generally flat frame the inside edge of which is shaped and sized to fit over and abut the outside wall of said preform body and extending outwards therefrom, and a cover shaped and sized to cover the top of the preform body; comprising the steps of:

a. placing the preform body in position within the predefined space;

b. placing the apron down over said preform body until that the inside edge of the apron frame lies against the bottom of the outside wall of said preform body;

c. placing said cover over the top of the preform body;

d. introducing the composite material around and over the assembled preform;

e. allowing the composite material to cure; and f. removing the cover and preform body from the cured composite material;

whereby a composite material free void is preserved within and below the predefined space that the preform had occupied.

18. The method of claim 17, wherein the preform body of the preform further comprises an inner collar spaced apart from the outer collar, the inner collar having an inside wall, and whereby the preform body is placed in position within the predefined space by placing the inner collar over of said preform body over and around a conduit extending from within the predefined space.

19. The method of claim 18, further comprising the step of adhering the inside wall of said inner collar to the conduit using adhesive.

20. The method of claim 19, wherein the inner collar and conduit is made of PVC material and the adhesive is PVC glue.

21. The method of claim 17, comprising the further steps of securing the apron and cover to the outside wall of the preform body using an adhesive.

22. The method of claim 17, wherein the outside wall of said preform body is inclined outwards going from top to bottom.

23. The method of claim 17, wherein said preform further comprises lips disposed along the inside edge of said apron to abut the bottom outside wall of said preform body, oriented upwards during assembly, and lips disposed along the outside edge of said cover to abut the top outside wall of said preform body, oriented downwards during assembly.

* * * * *